US009694476B2

(12) United States Patent
Bullard

(10) Patent No.: US 9,694,476 B2
(45) Date of Patent: Jul. 4, 2017

(54) METHOD AND APPARATUS FOR FORMING WIRE

(71) Applicant: Wubbers, LLC, Southlake, TX (US)

(72) Inventor: Patricia Bullard, Southlake, TX (US)

(73) Assignee: Wubbers, LLC, Southlake, TX (US)

( * ) Notice: Subject to any disclaimer, the term of this patent is extended or adjusted under 35 U.S.C. 154(b) by 341 days.

(21) Appl. No.: 14/281,447

(22) Filed: May 19, 2014

(65) Prior Publication Data

US 2014/0251492 A1 Sep. 11, 2014

Related U.S. Application Data

(63) Continuation of application No. 12/797,462, filed on Jun. 9, 2010, now Pat. No. 8,726,943.

(51) Int. Cl.
*B25B 7/02* (2006.01)
*A44C 27/00* (2006.01)
*B21F 1/00* (2006.01)

(52) U.S. Cl.
CPC ..... *B25B 7/02* (2013.01); *A44C 27/00* (2013.01); *B21F 1/002* (2013.01)

(58) Field of Classification Search
CPC .... B21F 1/002; B21F 1/06; B21F 7/00; B21F 37/00; B21F 45/00; B25B 7/02; B25B 7/12; A44C 27/00
USPC ..... 140/123
See application file for complete search history.

(56) References Cited

U.S. PATENT DOCUMENTS 1,519,550 A * 12/1924 Pozgay ..... B25B 7/12 140/102.5
1,602,119 A * 10/1926 Niebaum ..... B21F 1/002 140/106
3,956,950 A * 5/1976 Jamell ..... B21F 1/06 140/104
5,839,141 A * 11/1998 Hermann ..... B21F 1/002 81/426
7,124,786 B1 * 10/2006 Gowhari ..... H01R 43/033 140/117

* cited by examiner

*Primary Examiner* — Moshe Wilensky
*Assistant Examiner* — Pradeep C Battula
(74) *Attorney, Agent, or Firm* — Vincent J. Allen; Stephen Y. Liu; Carstens and Cahoon, LLP

(57) ABSTRACT

The present invention is a method and apparatus for forming wire loops using wire looping pliers. In one embodiment of the invention, the pair of wire pliers having a cylindrical jaw and a recessed jaw for accepting the cylindrical jaw allows the user of the tool to make symmetrical wire loops on a consistent basis. Additionally, the width of the recessed jaw can be set such that the user can use the recessed jaw to measure the distance from a particular point where the neck of the wire loop should be broken. The recessed surface of the recessed jaw and the cylindrical jaw mate together in such a manner as to provide uniform pressure around a significant portion of the loop so as to prevent marring of the surface of the wire.

8 Claims, 11 Drawing Sheets

METHOD AND APPARATUS FOR FORMING WIRE

CROSS-REFERENCE TO RELATED APPLICATIONS

This application is a Continuation of U.S. patent application Ser. No. 12/797,462 filed Jun. 10, 2010, now U.S. Pat. No. 8,726,943 granted May 20, 2014, which is incorporated herein by reference in its entirety.

BACKGROUND

1. Technical Field

The present invention relates to a method and apparatus for forming wire and more particularly to wire looping pliers and a method of using same during the manufacture of jewelry.

2. Description of Related Art

The art of hand making jewelry has become more popular in recent years. Professionals and amateurs alike have conducted substantial business making and selling handmade jewelry. In the process of making jewelry, tools are used to accomplish certain tasks. One task that is often performed in making jewelry is what is referred in the art as "wire looping." For example, wire looping can be used to create wire loops on two sides of a bead to enable attachment of the bead to other parts. Wire looping can also be used to form what is called an eye pin.

One of the problems with the current tools that are used to create wire loops is that it is difficult to consistently create a symmetrical loop. Current tools also tend to cause marring or distortion of the wire surface in certain places, leaving an undesirable appearance. Additionally, for determining where to "break the neck" of the wire loop, current tools require the user to guess where to place the tool that is used to form the loop to provide the appropriate spacing. This leads to mistakes and inconsistency in the appearance of the wire loops.

Therefore, there is a need for wire looping pliers that will allow for the consistent creation of wire loops with minimal distortion or marring of the surface of the wire. There is also need for a more precise means of measuring the distance or the location at which a wire loop should be formed to eliminate some of the guesswork required by current tools.

SUMMARY OF THE INVENTION

The present invention is a method and apparatus for forming wire loops using wire looping pliers. In one embodiment of the invention, the pair of wire pliers having a cylindrical jaw and a recessed jaw for accepting the cylindrical jaw allows the user of the tool to make symmetrical wire loops on a consistent basis. Additionally, the width of the recessed jaw can be set such that the user can use the recessed jaw to measure the distance from a particular point where the neck of the wire loop should be broken. The recessed surface of the recessed jaw and the cylindrical jaw mate together in such a manner as to provide uniform pressure around a significant portion of the loop so as to prevent marring of the surface of the wire.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
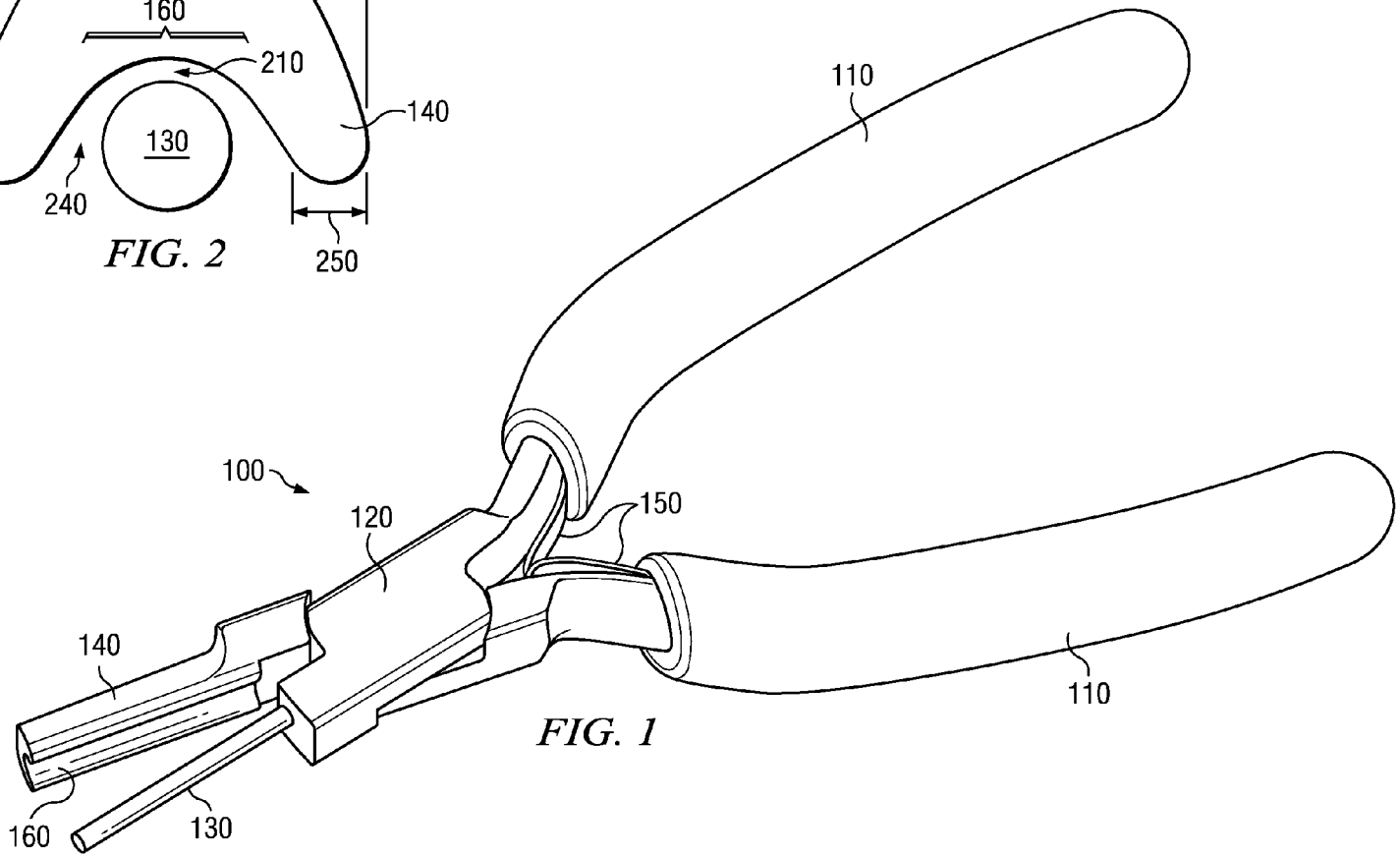
FIG. 1 is a perspective view of a pair of wire looping pliers in accordance with an embodiment of the invention.
Figure 2:
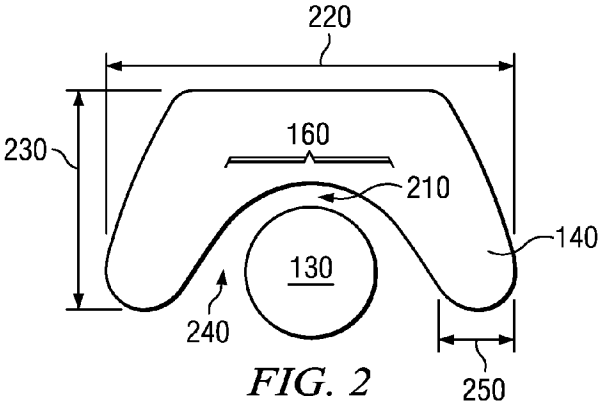
FIG. 2 is an end view of the jaws of a pair of wire looping pliers in accordance with an embodiment of the invention.
Figure 3:
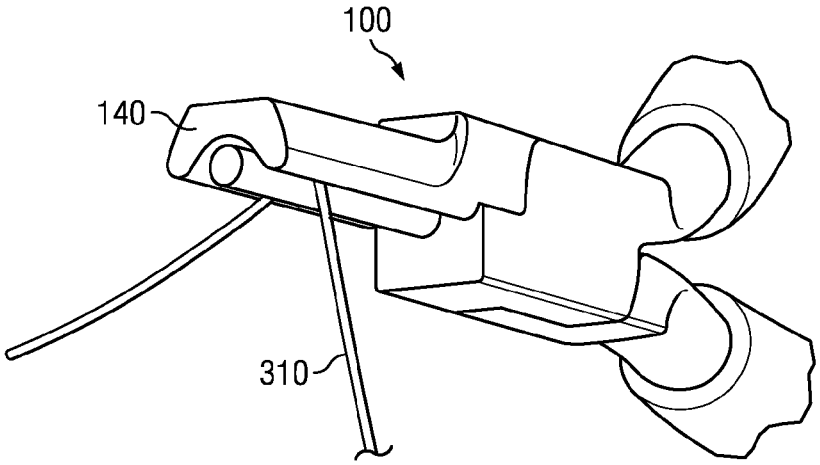
FIGS. 3-14 are illustrations of the steps taken in a method of forming wrapped loops on each side of a bead in accordance with an embodiment of the invention.

Referring now to FIG. 1, a perspective view of a pair of wire looping pliers 100 in accordance with an embodiment of present invention as illustrated. A pair of handles 110 are connected at a pivot 120. A cylindrical jaw 130 and a recessed jaw 140 are connected to the respective handles 110 at the pivot point 120 so as to allow the cylindrical jaw 130 and the recessed jaw to move from the open position shown in FIG. 1 to a closed position as shown in FIGS. 2-3. Springs 150 may also be attached to the handle 110 to cause the pliers to automatically return to the open position that is illustrated in FIG. 1 when the handles 110 are released. By squeezing the handles 110, the cylindrical jaw 130 mates with a trough 160 in the recessed jaw 140.

Referring now to FIG. 2, an end view of the jaws 130, 140 of the wire looping pliers 100 is illustrated. As show in FIG. 2, the cylindrical jaw 130 mates with the recessed jaw 140. Although not shown, a wire will be forced into compliance with the shape of the space 210 to form the wire into approximately a ninety degree bend with a radius that is approximately equal to the radius of the cylindrical jaw 130. However, the invention is not limited to tools that create bends of ninety degrees as it may be desirable depending on the application to have bends of different angles.

In one embodiment of the invention, the overall width 220 of the recessed jaw is approximately 5.5 millimeters. The height 230 of the recessed jaw can be set at 3.5 millimeters and the wall width 250 of the recessed jaw 140 can be set to 1.5 millimeters. The diameter of the cylindrical jaw 130 can be set at 1.5 millimeters. The pliers 100 can be constructed such that when the jaws are completely closed there is a slight gap 210 between the recessed jaw 140 and the cylindrical jaw 130. The gap can be such that it is smaller than the diameter of the wire to be formed so as to allow the wire to be securely gripped while preventing the user from applying excessive force that causes the wire to be marred or deformed. In one embodiment of the invention, the gap 210 may be set to 0.4 millimeters. This allows the pliers to grip wire sizes ideally in the 20 to 24 gauge range. However, one with skill in the art will understand that the dimensions of the jaws described above can be changed to accommodate different wire sizes, to allow for different sized loops to be formed, and to provide a guide as discussed below for where to form a loop to provide for a certain number of wraps on a wire loop.

For example, in an alternate embodiment of the invention, the overall width 220 of the recessed jaw 140 is approximately 7.5 millimeters. The height 230 of the recessed jaw can be set at 4.0 millimeters and the wall width 250 of the recessed jaw 140 can be set to 2.0 millimeters. The diameter of the cylindrical jaw 130 can be set at 2.5 millimeters. The gap 210 may be set to 0.7 millimeters. This allows the pliers to grip wire sizes ideally in the 18 to 20 gauge range.

In another alternate embodiment of the invention, the overall width 220 of the recessed jaw 140 is approximately 9.0 millimeters. The height 230 of the recessed jaw can be set at 4.5 millimeters and the wall width 250 of the recessed jaw 140 can be set to 2.0 millimeters. The diameter of the cylindrical jaw 130 can be set at 3.0 millimeters. The gap 210 may be set to 1.2 millimeters. This allows the pliers to grip wire sizes ideally in the 16 to 18 gauge range.

In order to help prevent marring, the gap 240 near the top of the trough 160 of the recessed jaw 140 is slightly larger than the gap 210 at the bottom of the trough 160 to help prevent damage to the wire during the bending process. The top edges of the trough 160 of the recessed jaw 140 are also rounded and smooth to help prevent marring of the wire as well and to allow the use of the top edges for bending the wire in a direction opposite to the bend created when the jaws 130, 140 are closed, also known as "breaking the neck."

Referring now to FIGS. 3-14, a method of forming wrapped loops on each side of a bead is illustrated. Referring now to FIG. 3, a wire 310 is inserted between the jaws of the pliers 100 and the user squeezes the handles 110 of the pliers 100 to cause the wire to bend. Using one embodiment of the pliers 100, the closing of the jaws 130, 140 causes a bend in the wire that is approximately 90 degrees although other angles are possible by changing the shape of the trough 140.

Figure 4:
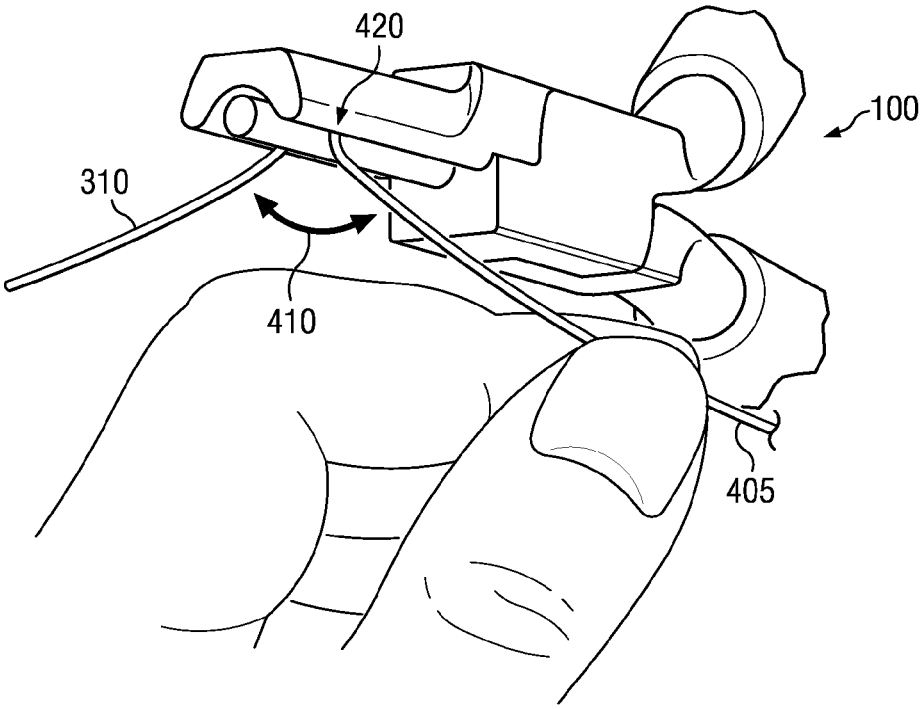
Figure 5:
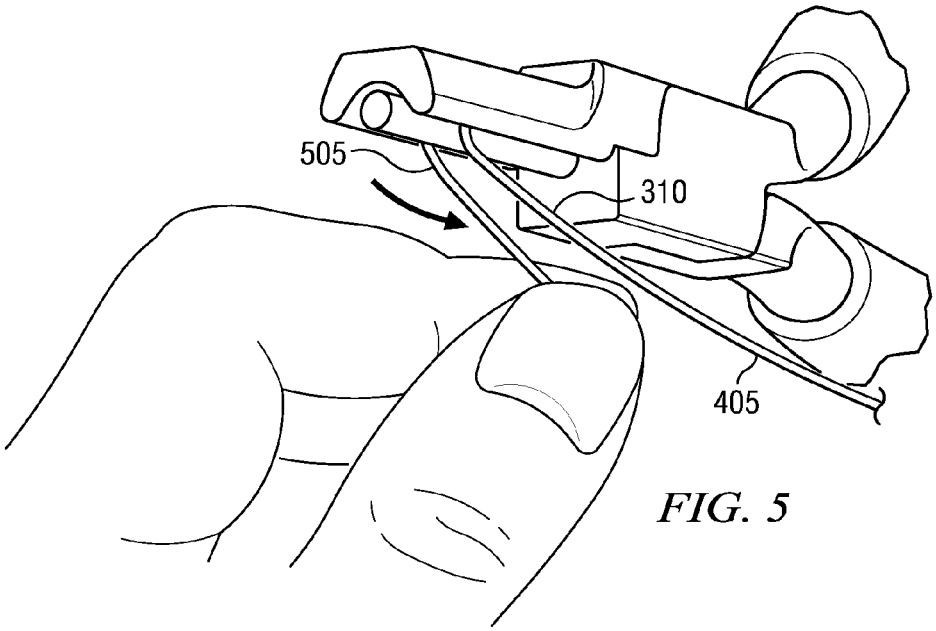

Referring now to FIG. 4, one leg 405 of the wire 310 is bent over the top edge 420 of one side of the trough 160 of the recessed jaw 140 so that the angle 410 between the two wire legs is approximately 135 degrees. Referring now to FIG. 5, the other leg 505 of the wire 310 is pulled to a position that is essentially parallel to the opposite leg 405. The steps shown in FIGS. 1-5 are taken while the user applies pressure to the handles to keep jaws pressed against the wire 310 to hold it in place.

Figure 6:
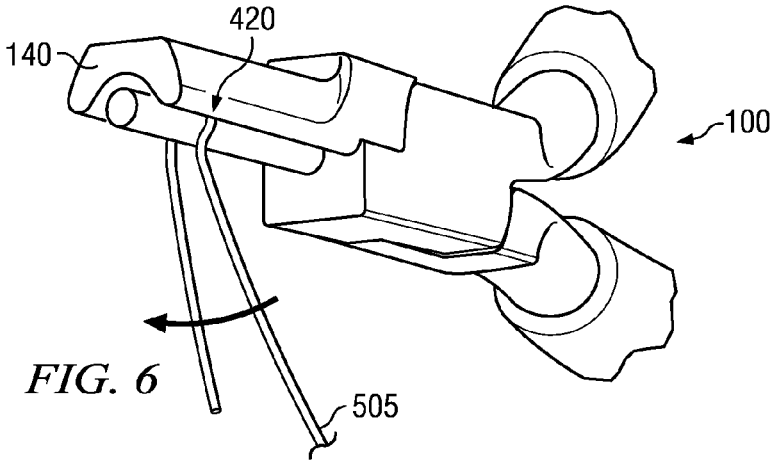

Referring now to FIG. 6, the jaws 130, 140 are opened slightly to allow the wire to be rotated slightly such that the leg 505 extends outward at an angle while keeping the break in the neck close enough to the top edge 420 of the trough 160 of the recessed jaw 140 to allow the top edge 420 to provide support to leg 505 during wrapping of the neck while being sufficiently spaced from the edge 420 to allow the neck to be completely wrapped.

Figure 7:
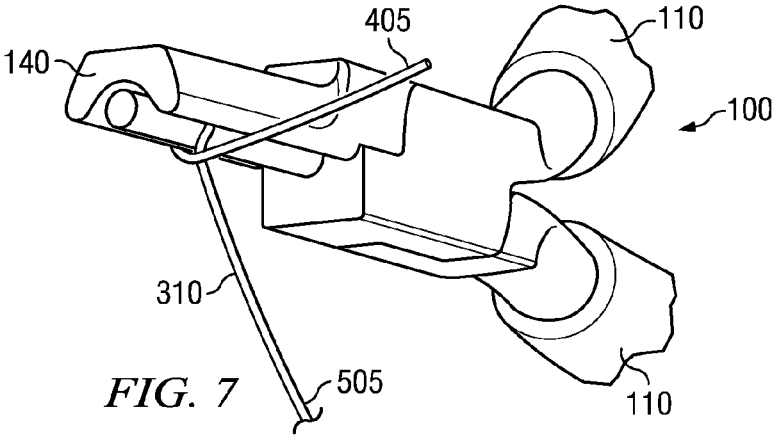
Figure 8:
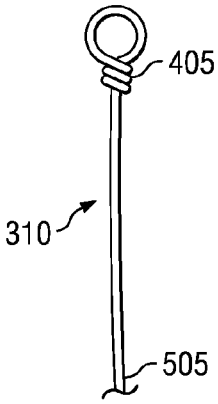

Referring now to FIG. 7, the user of the pliers 100 reapplies pressure to the handles 110 to grip the wire 310 in place and the short leg 405 of the wire 310 is then bent across the opposite leg 505 as shown in FIG. 7 and wrapped around the leg 505 to form a symmetrical wire loop as shown in FIG. 8. Once the desired wraps have been turned, the user then clips the remaining portion of the leg 405 from the loop. When wrapping the wire as shown in FIG. 7, the end of the wire 405 can be gripped with another pair of pliers to perform the wrapping. By providing a tight tension as the wire is wrapped, the wraps will be evenly spaced and snug against each other.

Figure 10:
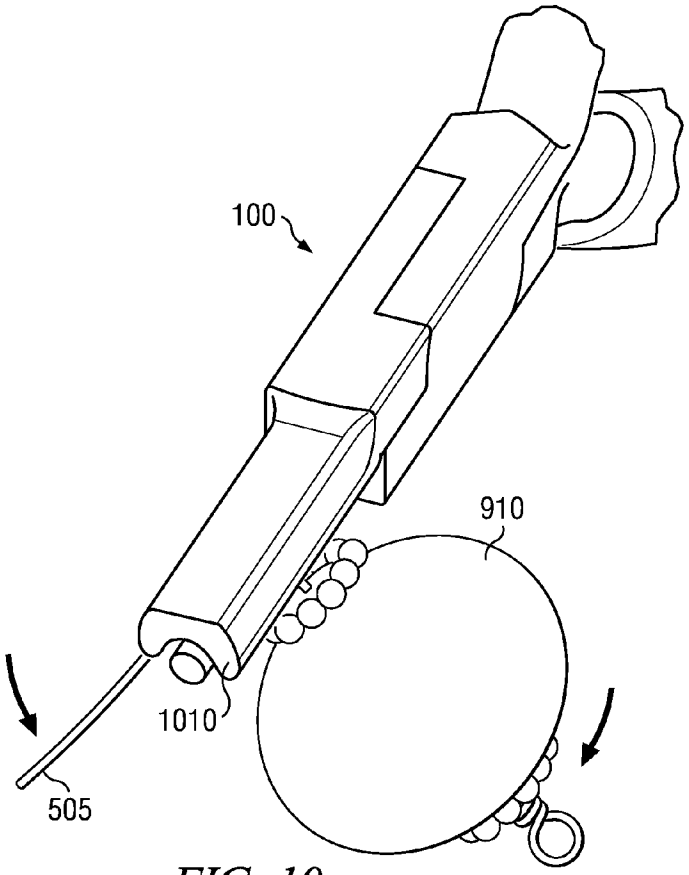
Figure 9:
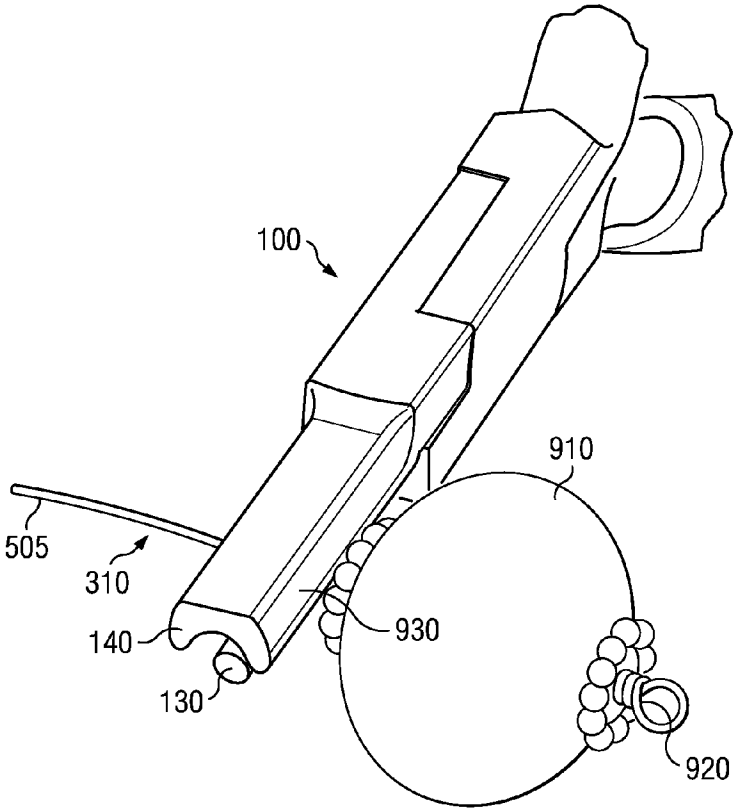

Referring now to FIG. 9, a bead 910 is threaded over the end 505 of the wire 310 and pushed snug against the wrapped loop 920. The pliers 100 are then placed by the user immediately adjacent to the opposite side of the bead 910 with the side 930 of the recessed jaw 140 resting against the bead 910. The jaws 130, 140 are then closed by the user resulting in the wire leg 505 being bent to an angle that is approximately 90 degrees relative to the axis of the bead 910 as shown in FIG. 10. The thickness 250 of the side 1010 of recessed jaw 140 is such that when the pliers 100 are placed adjacent to the bead 910 and the bend made, the bend will be in the correct position to allow wire to be wrapped the desired number of times while giving a snug fit against the bead 910.

Figure 12:
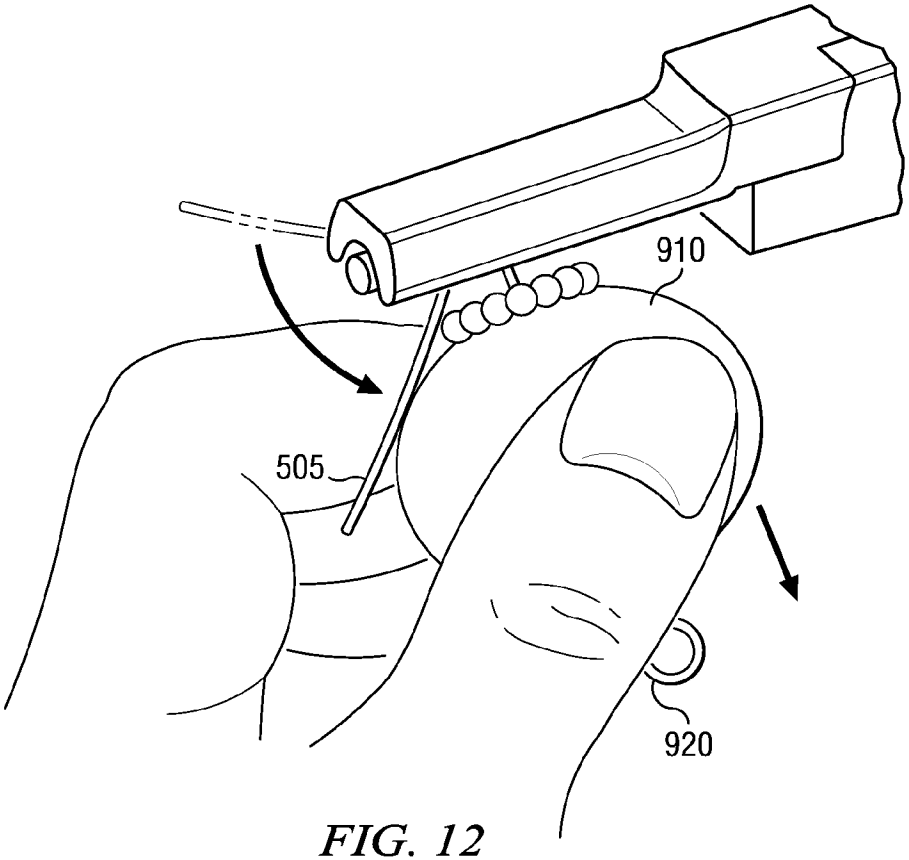
Figure 11:
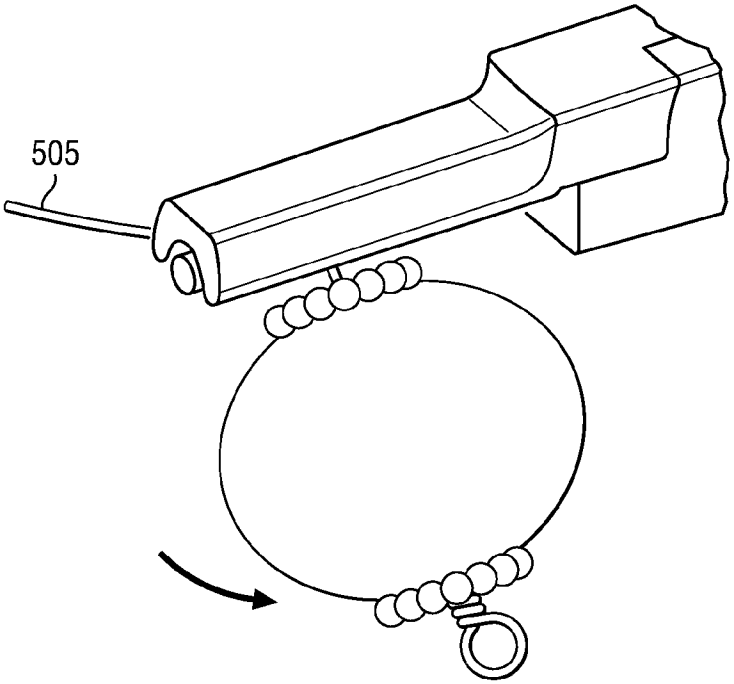
Figure 13:
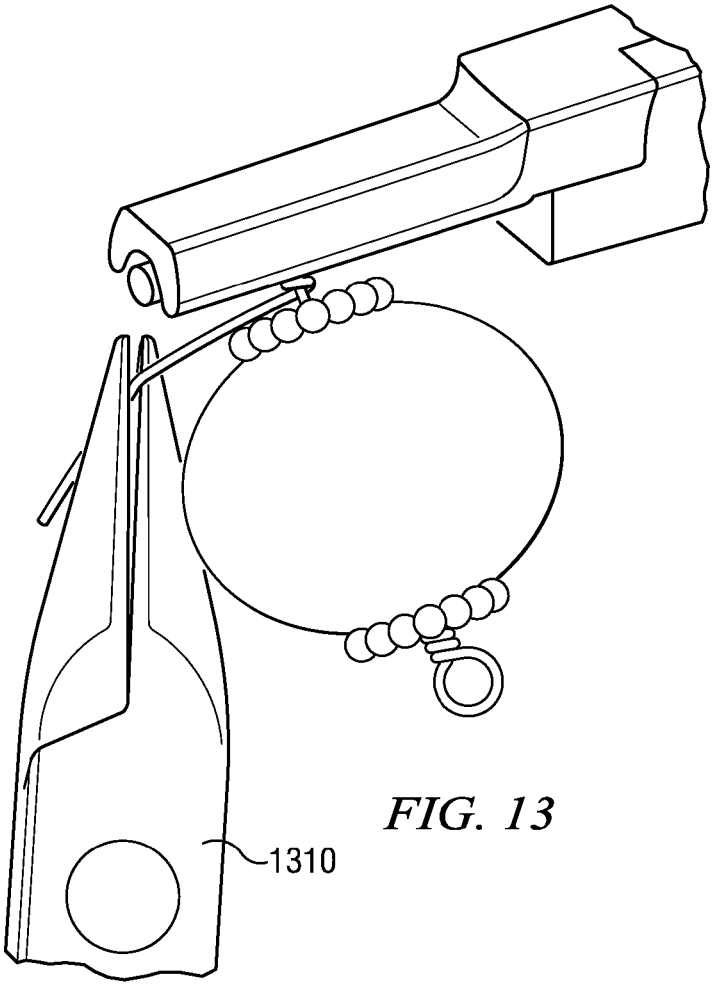
Figure 14:
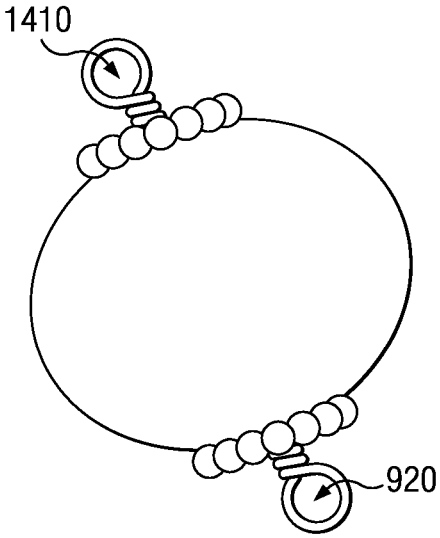

Once the 90 degree bend is performed as shown in FIG. 10, the user then opens the angle between the leg 505 and the axis of the bead 910 to approximately 135 degrees by rotating the pliers while maintaining the grip on the wire as shown in FIG. 11. While holding the pliers 100 in the same position as illustrated in FIG. 11 and continuing to grip the wire, the user then bends the leg 505 of the wire so that it touches the side of the bead 910. While making sure that the bead is snug against the wire loop 920 as shown in FIG. 12, the wire end 505 is then wrapped around the wire 310 using a separate set of pliers 1310 as shown in FIG. 13. The finished product that results from this method is shown in FIG. 14. Note that the wire loops 920, 1410 are symmetrical and that the windings are tight, creating a pleasing appearance.

Figure 15:
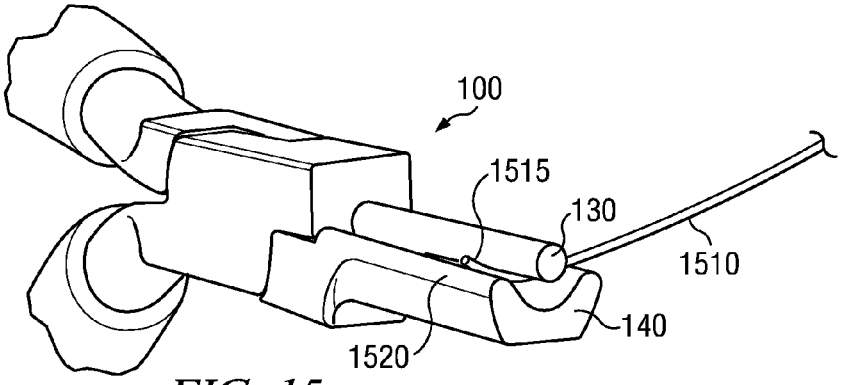
FIGS. 15-19, are illustrations of the steps taken in a method of forming an eye pin in accordance with an embodiment of the invention.
Figure 16:
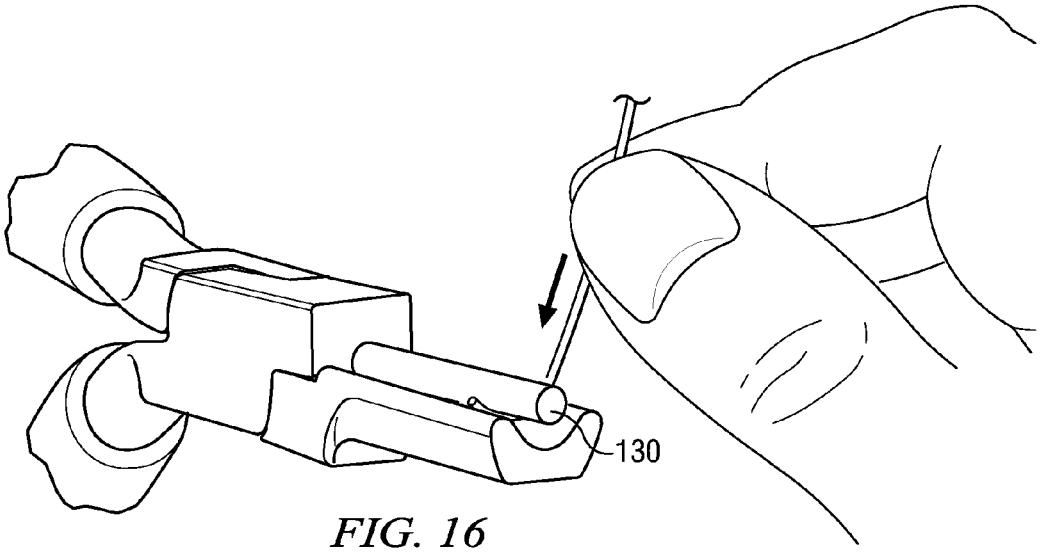
Figure 17:
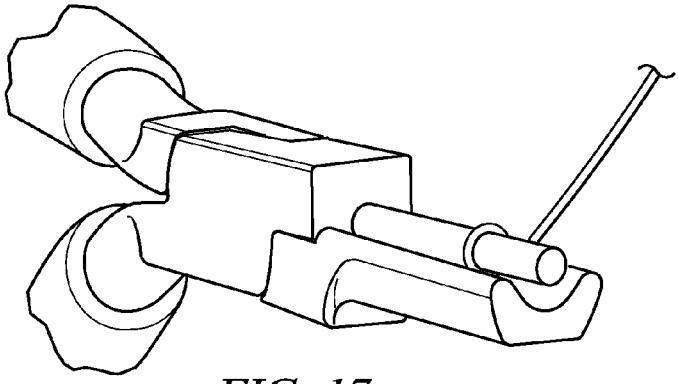
Figure 18:
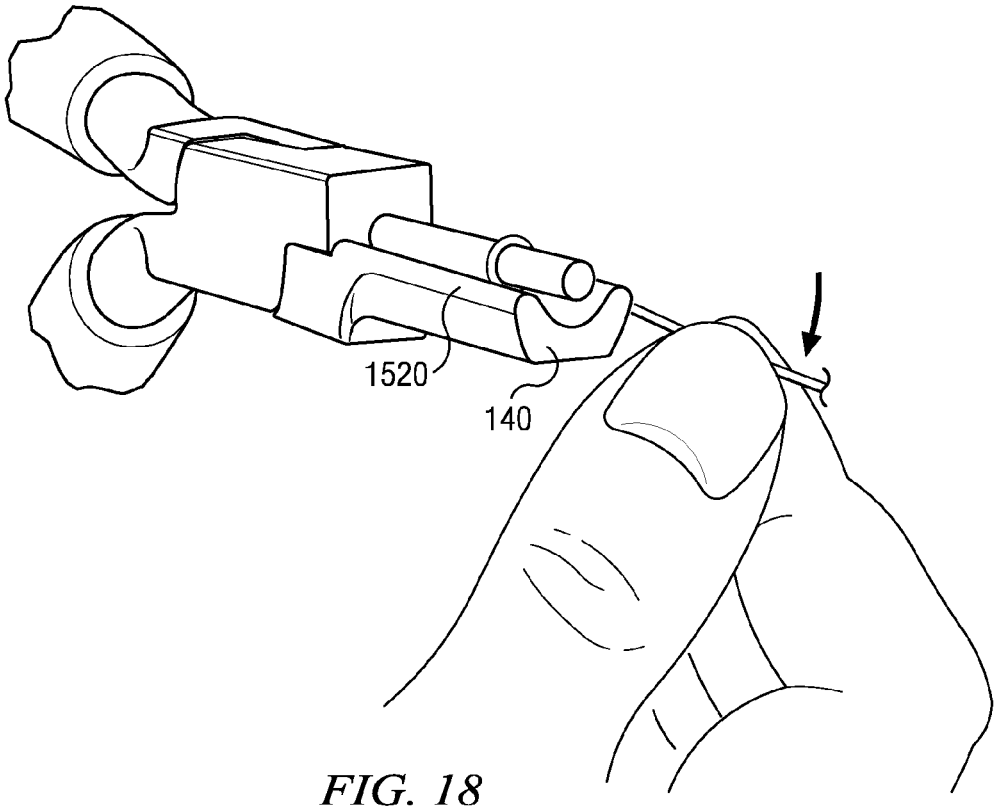
Figure 19:
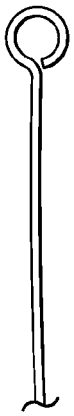

Referring now to FIGS. 15-19, a method of forming an eye pin is illustrated. Referring now to FIG. 15, a wire 1510 is placed between the jaws of the pliers 100 in such a manner that an end 1515 of the wire 1510 is underneath the cylindrical jaw 130. The user then squeezes the handles of the pliers 100 to form a bend in the wire. As shown in FIG. 16, the jaws are repeatedly opened and closed while the wire is worked around the cylindrical jaw 130 to form a complete circle as shown in FIG. 17. Once the complete circle is formed, the user then bends the wire 1510 against the top edge 1520 of the recessed jaw 140 as shown in FIG. 18 so as to form an eye pin as shown in FIG. 19.

The methods described are easily repeated and create a symmetrical loop shape. The method described makes it easy to center the loop over the wire without distorting or bending the loop. Additionally, the user can create consistent loops time after time without guessing as to where to break the neck. The simplicity of the tool used makes it relatively cheap to manufacture compared to other tools.

Referring now to FIGS. 20-24, an alternative method of forming wrapped loops on each side of a bead is illustrated. In some cases, it may be desirable for the wrapped loop on each side of a bead to have a longer neck than the neck created using the method described above with reference to FIGS. 3-14. However, the wall width 250 of recessed jaw 140 may be too small to provide an accurate guide for measuring the distance from the bead to create the bend described above with reference to FIG. 9. Nevertheless, it is possible to accurately measure the location of the bend for a longer neck by revising the method described above.

Figure 20:
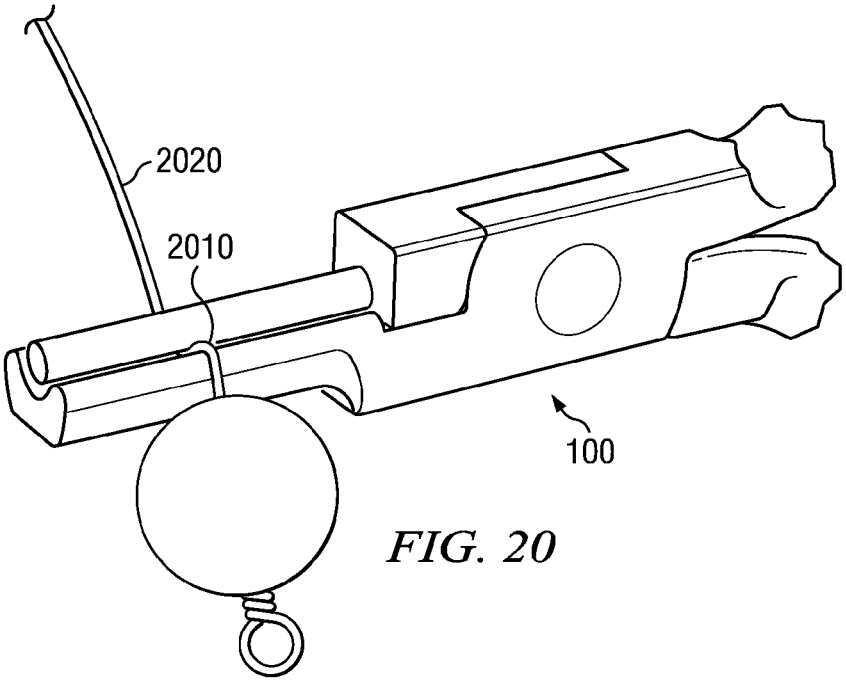
FIGS. 20-24, are illustrations showing certain alternative steps in a method of forming wrapped loops on each side of a bead in accordance with an embodiment of the invention.
Figure 21:
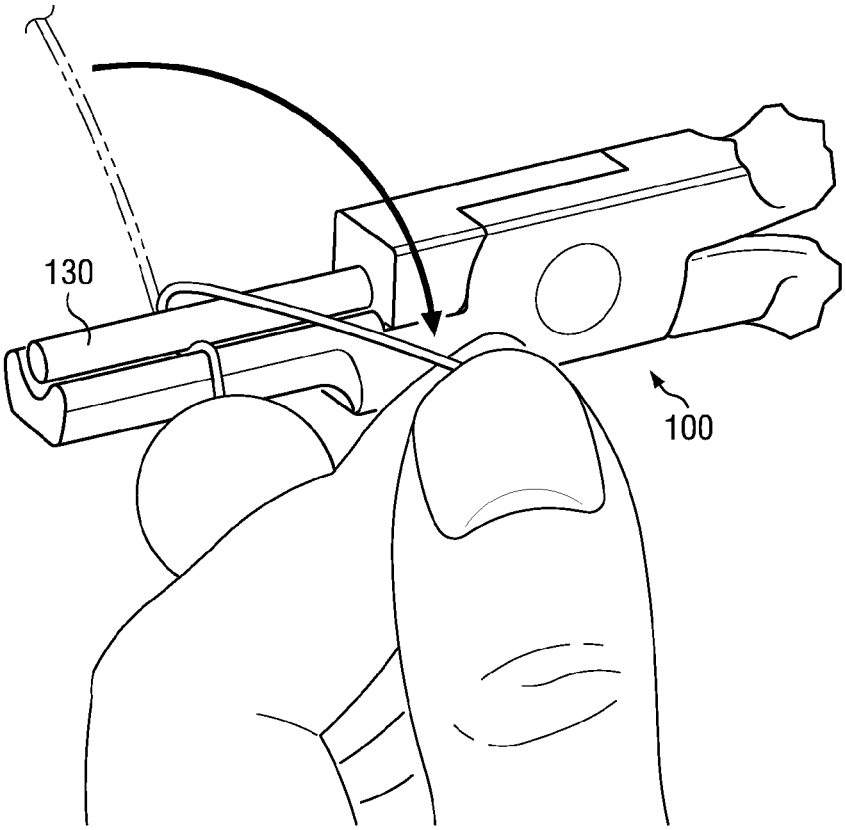
Figure 22:
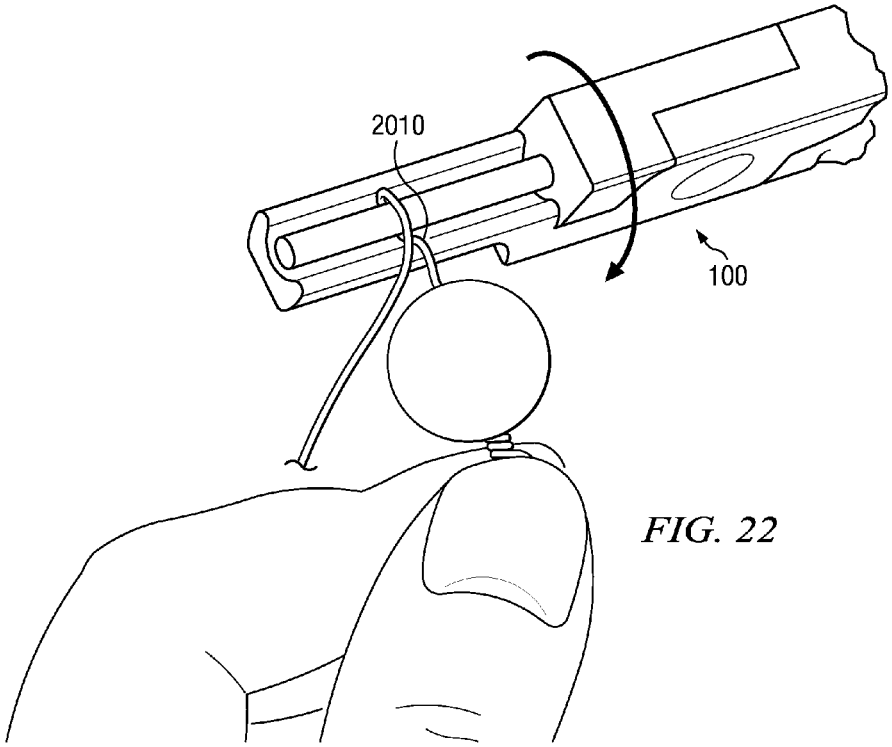
Figure 23:
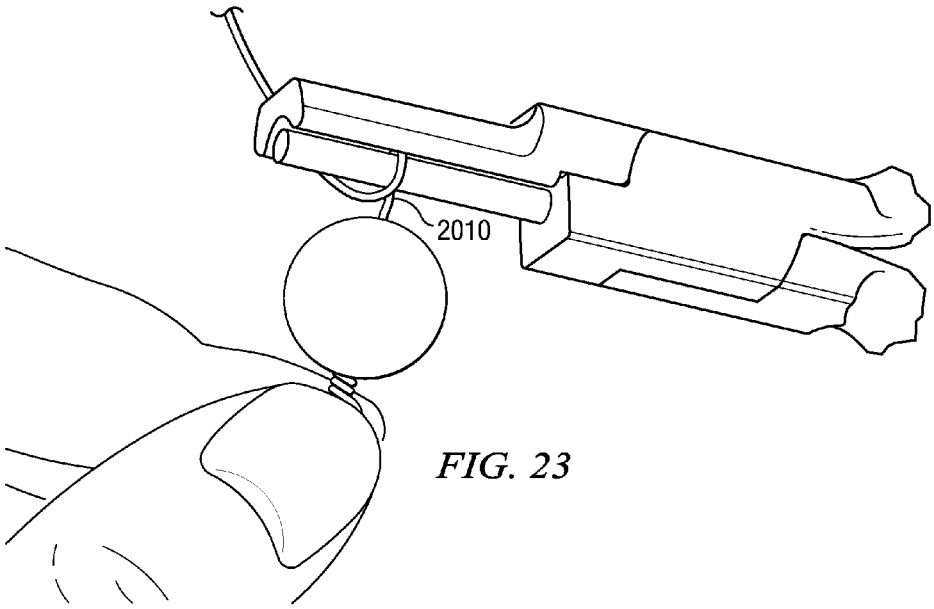
Figure 24:
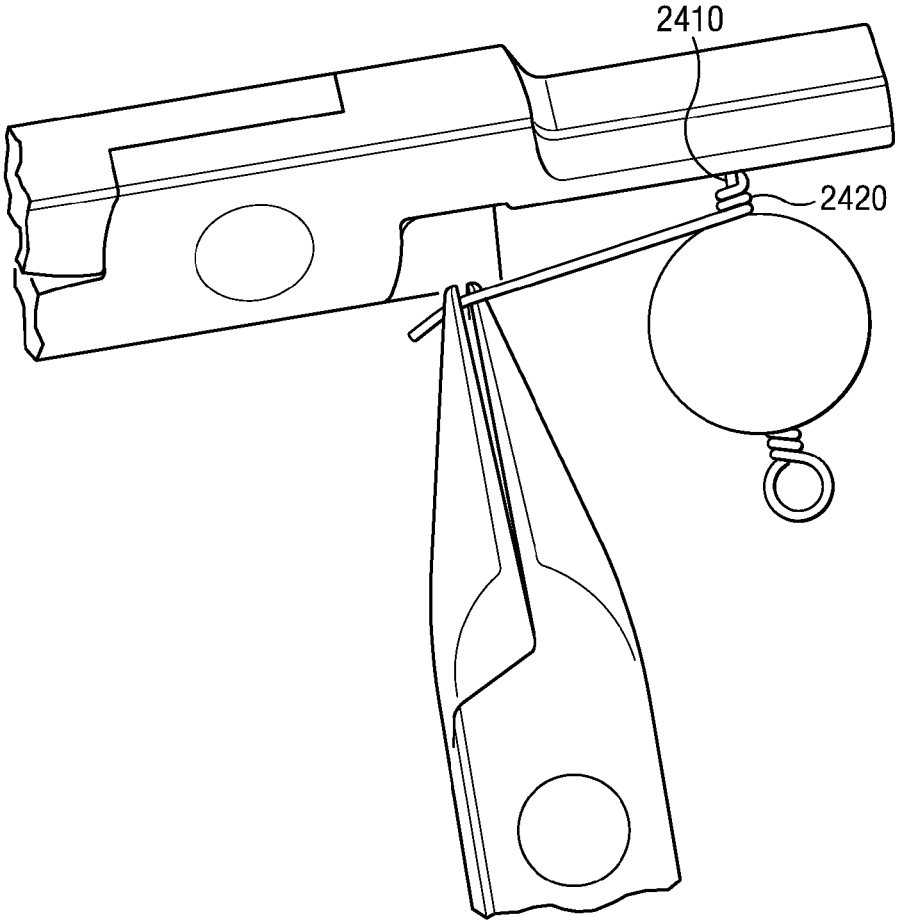

The first wrapped loop is created in the manner described above with the desired number of wraps necessary to create a long neck on the first loop. The wire is threaded through the bead and a bend is performed on the end of the bead opposite the first loop that is created as described with reference to FIG. 10. The method then changes slightly from that described above to create the second loop. With reference to FIG. 20, the pliers 100 are placed adjacent the bend 2010 just created and another bend is formed in the wire 2020 by squeezing the pliers 100. With reference now to FIG. 21, the wire 2020 is then bent around the cylindrical jaw 130 of the pliers 100. With reference now to FIG. 22, the loop is closed and the pliers are rotated while keeping the jaws closed until the loop is centered over the wire, straightening the bend 2010 but not completely. Referring now to FIG. 24, the neck of the wire is wrapped until the space between the bead is filled resulting in wrapped loop with a long neck 2420.

This method is best used with wire that is at least 16 to 20 gauge because lighter weight wire is apt to bend and distort as the jewelry is worn. Of course, different length necks can be created by varying the width 250 of the wall of recessed jaw. But using the method described with reference to FIGS. 20-24 allows the same pair of pliers to precisely measure the bend location to form two different neck lengths.

Although the invention hereof has been described by way of a preferred embodiment, it will be evident that other adaptations and modifications can be employed without departing from the spirit and scope thereof. The terms and expressions employed herein have been used as terms of description and not of limitation; and thus, there is no intent of excluding equivalents, but on the contrary it is intended to cover any and all equivalents that may be employed without departing from the spirit and scope of the invention. For example, using the same basic shapes, a pair of pliers having multiple cylindrical portions for the cylindrical jaw as well as multiple recessed portions could also be manufactured so that one tool could accommodate multiple wire sizes. Additionally, various sizes and shapes of the jaws could be implemented without departing from the scope and spirit of the invention.

What is claimed is:

1. A method of forming a wire coil comprising:

a) placing a wire between a substantially cylindrical jaw and a recessed jaw of a wire looping pliers, the substantially cylindrical jaw having a substantially uniform cross section throughout a length of said substantially cylindrical jaw; and b) bending said wire partially around said substantially cylindrical jaw by applying a squeezing force to a first handle and a second handle of said wire looping pliers to cause said recessed jaw to conform a section of said wire to a shape of said substantially cylindrical jaw;

wherein said substantially cylindrical jaw and said recessed jaw are opposed and adapted for moving with respect to each other in response to a force being applied to said first handle and said second handle of said wire looping pliers and wherein a distance between said recessed jaw and said substantially cylindrical jaw in the fully closed position is configured based on a size of a wire to be worked and wherein said length of said substantially cylindrical jaw is sufficient to allow a plurality of same-sized loops to be formed to create the wire coil.

2. The method of claim 1 further comprising the steps:

c) gripping said wire between said substantially cylindrical jaw and said recessed jaw; and d) bending said wire further by applying an external force to said wire during said step of gripping said wire.

3. The method of claim 2 wherein said step d) of bending said wire further by applying an external force comprises breaking a neck by pulling a first leg of said wire against a curved top edge of said recessed jaw such that an angle between a first leg and a second leg of said wire is approximately one hundred thirty-five degrees, pulling a second leg of said wire around said substantially cylindrical jaw to a position that is in the direction of said first leg of said wire, stopping said gripping of said wire momentarily and rotating said wire around said substantially cylindrical jaw approximately ninety degrees away from said curved top edge, re-gripping said wire, and wrapping said second leg of said wire around said first leg to form a first closed loop around said substantially cylindrical jaw.

4. The method of claim 3 further comprising the steps e) removing said wire from said substantially cylindrical jaw;

f) inserting an end of said first leg of said wire into a bead;

g) placing said first closed loop adjacent to a first end of said bead;

h) grasping said first leg of said wire while holding a side of said recessed jaw of said pliers adjacent to a second end of said bead;

i) bending said first leg of said wire partially around said substantially cylindrical jaw by applying a squeezing force to said first handle and said second handle of said wire looping pliers wherein a thickness of said side of said recessed jaw determines a spacing between said second end of said bead and the start of a bend formed during said step i);

j) while continuing to apply said squeezing force, breaking a second neck by applying force to open up an angle between an axis of the bead and said first leg of said wire to approximately one hundred thirty-five degrees;

k) pulling said first leg of said wire around said substantially cylindrical jaw;

l) releasing said squeezing force and rotating said pliers away from said bead to open up a space between said second neck and said bead;

m) applying said squeezing force again and wrapping said first leg of said wire in said space.

5. The method of claim 1 wherein said step of bending said wire partially around results in a bend being formed in said wire wherein an angle between a first leg of said wire and a second leg of said wire is approximately ninety degrees.

6. The method of claim 1 wherein a first end of said wire is disposed between said substantially cylindrical jaw and said recessed jaw during said step of bending and further comprising the step c) repeatedly rotating said wire and applying said squeezing force until said wire is wrapped around a circumference of said substantially cylindrical jaw.

7. The method of claim 6 further comprising the step d) while applying said squeezing force, bending a second end of said wire against a side of said recessed jaw to form an eye pin.

8. A method of forming a wire coil comprising:

a) placing a wire between a substantially cylindrical jaw and a recessed jaw of a wire looping pliers, the substantially cylindrical jaw having a substantially uniform cross section throughout a length of said substantially cylindrical jaw; and b) bending said wire partially around said substantially cylindrical jaw by applying a squeezing force to a first handle and a second handle of said wire looping pliers to cause said recessed jaw to conform a section of said wire to a shape of said substantially cylindrical jaw; wherein said substantially cylindrical jaw and said recessed jaw are opposed and adapted for moving with respect to each other in response to a force being applied to said first handle and said second handle of said wire looping pliers and wherein a distance between said recessed jaw and said substantially cylindrical jaw in the fully closed position is configured based on a size of a wire to be worked and wherein said length of said substantially cylindrical jaw is sufficient to allow a plurality of same-sized loops to be formed to create the wire coil;

c) gripping said wire between said substantially cylindrical jaw and said recessed jaw;

d) bending said wire further by applying an external force to said wire during said step of gripping said wire;

e) removing said wire from said substantially cylindrical jaw;

f) inserting an end of said first leg of said wire into a bead;

g) placing said first closed loop adjacent to a first end of said bead;

h) grasping said first leg of said wire while holding a side of said recessed jaw of said pliers adjacent to a second end of said bead;

i) bending said first leg of said wire partially around said substantially cylindrical jaw by applying a squeezing force to said first handle and said second handle of said wire looping pliers wherein a thickness of said side of said recessed jaw determines a spacing between said second end of said bead and the start of a bend formed during said step i);

j) while continuing to apply said squeezing force, breaking a second neck by applying force to open up an angle between an axis of the bead and said first leg of said wire to approximately one hundred thirty-five degrees;

k) pulling said first leg of said wire around said substantially cylindrical jaw;

l) releasing said squeezing force and rotating said pliers away from said bead to open up a space between said second neck and said bead;

m) applying said squeezing force again and wrapping said first leg of said wire in said space.

* * * * *